United States Patent [19]

Deville et al.

[11] 4,371,852

[45] Feb. 1, 1983

[54] VARIABLE PITCH DELAY LINE FOR TRAVELLING-WAVE TUBE AND TRAVELLING-WAVE TUBE EQUIPPED WITH SUCH A LINE

[75] Inventors: Christian Deville; Philippe Lafuma, both of Paris, France

[73] Assignee: Thomson-CSF, Paris, France

[21] Appl. No.: 163,541

[22] Filed: Jun. 27, 1980

[30] Foreign Application Priority Data

Jul. 3, 1979 [FR] France ..... 79 17201

[51] Int. Cl.[3] ..... H01P 9/00; H01J 23/24

[52] U.S. Cl. ..... 333/157; 315/3.5

[58] Field of Search ..... 315/3.5; 330/43; 333/156, 157, 245, 248

[56] References Cited

U.S. PATENT DOCUMENTS 3,527,976 9/1970 Thal, Jr. ..... 330/43 X

*Primary Examiner*—Marvin L. Nussbaum

*Attorney, Agent, or Firm*—Roland Plottel

[57] ABSTRACT

A variable pitch delay line for a travelling wave tube, is constituted by cells constructed in waveguide sections in which takes place the propagation of the electromagnetic waves which are used in the operation of the tube. All the cells are constituted by the same components, namely tops or covers, a ring, supporting rods for the ring and a short-circuit. The variable pitch is obtained by expansion or contraction of the dimensions within the guide cross-section. A significant improvement of the tube efficiency is obtained by the use of lines formed from three sections with different pitches, which succeed one another along the path of the beam, whereof the second section has a smaller pitch and the third section a larger pitch than the first section.

9 Claims, 2 Drawing Figures

VARIABLE PITCH DELAY LINE FOR TRAVELLING-WAVE TUBE AND TRAVELLING-WAVE TUBE EQUIPPED WITH SUCH A LINE

BACKGROUND OF THE INVENTION

The present invention relates to a delay line for a cylindrical travelling-wave tube, particularly an amplifier, as well as to the tube equipped with such a line. It relates more particularly to the realisation of the variable pitch in such a line. The delay line according to the invention is considered to be of the type with tops and rings.

It comprises a metal guide, e.g. a cylindrical guide and, in the cross-sections of said guide, coaxial metal rings, each of which is fixed to the guide wall by at least one metal rod. It also comprises at least one top or cover constituted by a metal wedge fixed to the inner wall of the guide and extending over the entire length of the latter.

In the tube, the electron beam is transmitted along the preceding guide axis which, without it being obligatory, may constitute the vacuum envelope of the tube. The operation of the tube is based on the interaction between the electromagnetic waves which are propagated along the delay line and the electron beam.

Such lines are known in the travelling-wave tube art, particularly from U.S. Pat. No. 2,942,143. They are formed by a succession of elementary portions or cells, which are all identical and occur periodically along the transmission axis of the electron beam. There are a number of variants thereof, whereof one provides for the electrical interconnection of the tops by a single metal wire, more particularly forming a closed loop in order to eliminate certain interfering operating modes and when the line has a plurality of tops, cf U.S. Pat. No. 3,353,121. In this way, even if said interfering modes are not eliminated, they are at least transferred to frequencies outside the operating band of the tube on the principle mode. Thus, for example, in the case of a tube operating in the S band at about 3 gigahertz, the interfering modes in question are generally transferred to about 6 gigahertz.

The interest of a variable pitch for said lines was soon recognised in the travelling-wave tube art, more particularly for the reason of the efficiency of the tubes in which they are incorporated. The pitch of a delay line constituted, like those involved here, by a regular alignment of identical elements, is the distance between homologous points of two consecutive elements.

BRIEF SUMMARY OF THE INVENTION

The present invention relates to a delay line for a travelling-wave tube of the type having a top (or tops) and rings, with a variable pitch.

BRIEF DESCRIPTION OF THE DRAWINGS

The invention is described in greater detail hereinafter relative to non-limitative embodiments; the attached drawings, show.

DETAILED DESCRIPTION OF THE PREFERRED EMBODIMENTS

The results sought by the invention is the improvement of the efficiency of travelling-wave tubes. To this end, the invention provides for the realisation of the delay line of said tubes with a variable pitch under the conditions described hereinbefore.

Figure 1:
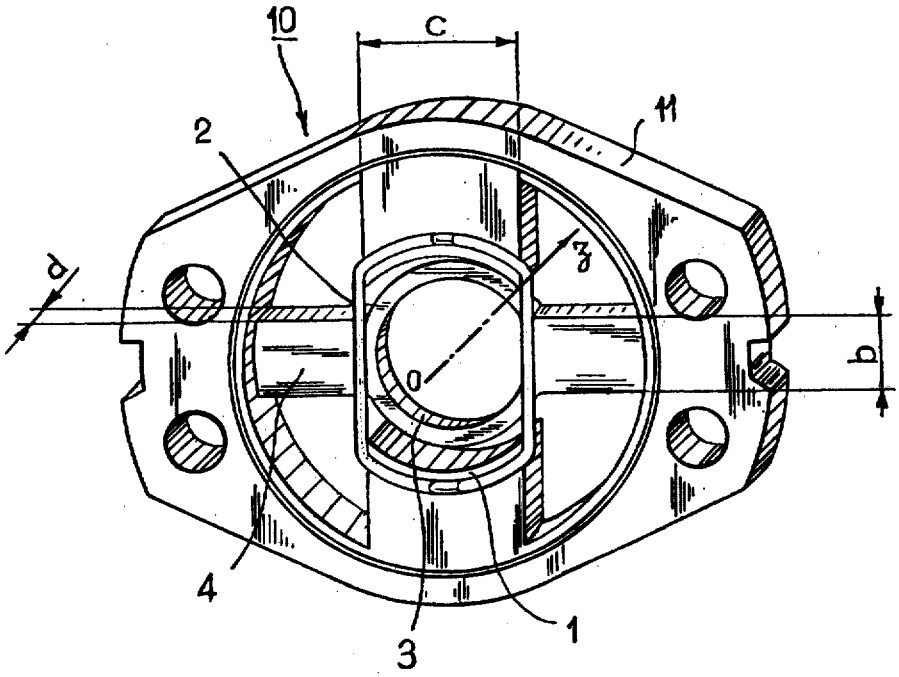
FIG. 1 an overall perspective view of the cell constituting the delay line according to the invention.

FIG. 1 is a perspective view of an elementary cell 10 of a delay line according to the invention. In accordance with the patents referred to hereinbefore each of the cells comprises a metal wave guide portion 11 having a circular hollow cross-section with an axis orthogonally directed with regard to the planes limiting said portion on either side, two arcuate edged metal tops 1 projecting symmetrically from the periphery of the cross-section to a certain distance from the centre of the same. Those teeth have the general shape of circular ring segments. In a plane parallel to that of the tops is provided a circular metal ring 3 supported by two diametrically opposite rods 4 fixed to the wall of the guide portion.

The two tops 1 are interconnected by a plane loop 2 made from electrically conductive material. In the example, this loop or short-circuit is constituted by a wire, bent so as to join its two ends; it rests on the two tops.

The drawing shows the four holes which in this case serve to cool the line by the circulation of fluid. The various guide portions are mounted and locked against one another in order to form the delay line according to the invention. The rods 4 are all parallel to one another, as are the tops 1. The assembly is made vacuum-tight by brazing.

Figure 2:
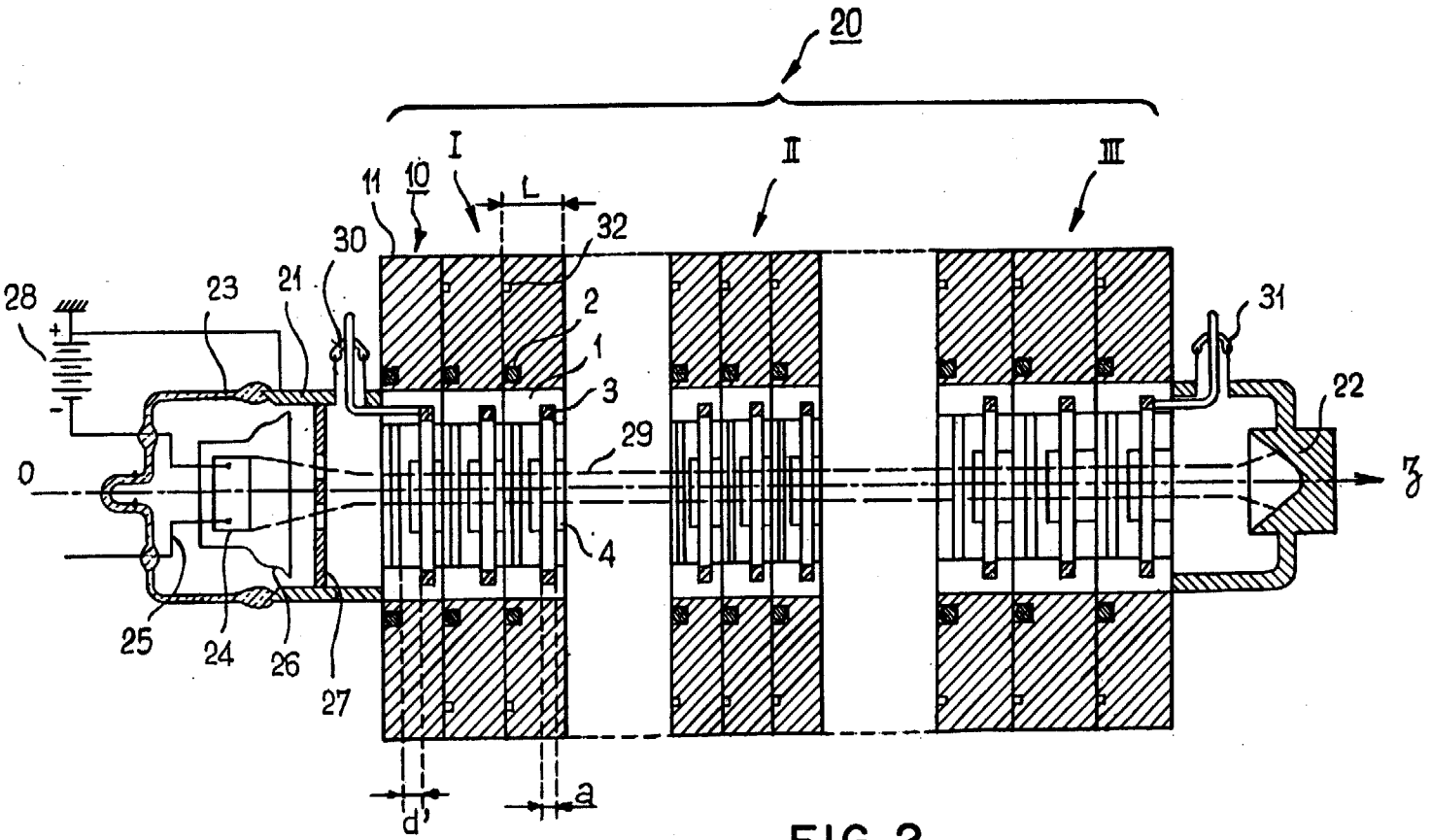
FIG. 2 a diagrammatic sectional view of a travelling-wave tube incorporating a delay line according to the invention.

The result of an example of this assembly is shown in sectional form in FIG. 2 where are shown with the same reference numerals cells having the same general structure as in the previous drawing. FIG. 2 has three sections I, II and III running from left to right along the beam transmission axis Oz. The pitch L of the line which is constant in each of these sections is given different values. The pitch L within one section is equal to the thickness of the cell.

According to the invention, the variation of pitch L is obtained by modifying within each cell either the dimensions of the components thereof such as the thickness of the supporting rod-ring assembly, or the distance between the ring and the short-circuit.

In this way, it is possible to vary slowly and optionally continuously in accordance with the desired law, the pitch of the delay line. The amount of delay imparted to the electromagnetic wave propagating along the line varies in the opposite direction to the pitch.

In FIG. 2, it is possible to see a line with three main portions having different pitches, the pitch being constant within each of the portions. The latter are interconnected by other not shown line portions where the pitch varies progressively from its value in the left-hand portion to that in the right-hand portion. The dimensional differences are exaggerated in the drawing to illustrate the pitch variation from one section to the next. It can be seen that in band S, the delay line has a length of a few dozen centimeters, whereas the thickness of a cell is only a few millimeters.

As can be seen in FIG. 2, the pitch of the structure firstly decreases (section II) compared with that in the first section I close to the electron gun and then increases in section III beyond its value in section I.

The thickness of the assembly formed by ring 3 and its supporting rods 4, which thickness is approximately uniform in the embodiment of FIG. 1, is designated by d. The distance between ring 3 and short-circuit 2 is designated by d' in FIG. 2. The thickness of the supporting rods is much greater than that of the ring in FIG. 2, which corresponds to one of the possible variants of the invention.

Experimental work carried out by the Applicant has shown that in order to obtain the desired efficiency increase, everything else being equal, the pitch of the delay line on moving away from the electron gun must firstly decrease and then increase in the final part of the line. This is the opposite to the ideas of the prior art according to which the pitch of the delay structure had to decrease in the last part thereof opposite to the electron gun. It would also appear that the dispersion of the electron velocities within the beam does not increase prohibitively in the last section, despite the significant increase in the efficiency obtained with the delay lines according to the invention.

This efficiency has reached values of 50% during tests carried out by the Applicant in the case of extreme pitch variations of +9% compared with the initial pitch, i.e. the pitch of section I. The efficiency referred to here is the ratio of the high frequency power collected at the output of the tube to the continuous power applied to the tube. Within the scope of the invention, these variations can be between a few hundredths of the pitch and a few times the said pitch.

As has been stated hereinbefore, the variation of the pitch of the line according to the invention can be obtained in two ways, namely either by modifying the thickness of assembly 3–4 formed by the ring and its supports, or by modifying the distance between ring 3 and short-circuit 2. The first is the more effective for varying the pitch. It also has the advantage of causing low disturbance to the coupling impedance between the electron beam and the delay line.

The improvement in the efficiency obtained with the delay line according to the invention is further increased by the said coupling impedance. Thus, with the arrangement according to the invention the increase in the pitch in the last part of the line is not incompatible with a reduction in the coupling impedance in said part, so that there is a reduced dispersion of the electronic velocities which is confirmed by calculations.

The focusing of the electron beam is facilitated and the beam transmission coefficient improved. The electron losses along the line are smaller, permitting a better utilization factor of the beam, and a high mean high frequency power available at the tube outlet, all other things being equal.

Moreover, by "enlarging" the elementary cells in order to increase their pitch, the thermal impedance of the line at the location of said cells is reduced, whilst increasing its dissipation possibilities, which is doubly advantageous.

Finally, it should be noted that a low coupling impedance generally corresponds to a relatively non-dispersive structure, i.e. a wide pass-band. Thus, the arrangements provided by the invention for increasing the tube efficiency favour a greater band width which, as is known, is one of the main characteristics of travelling-wave tubes.

At the same time as varying the pitch, other modifications within the cell make it possible to reduce the coupling impedance, more particularly the increase in the thickness of rings 3, dimension a, which can pass from single to double, increasing the width of the supporting rods of ring 4, dimension b, and increasing the width of tops 1, dimension c.

The tops can also be provided with splines, i.e. stepped edges can be provided on said tops. As a result, the impedance can be reduced to a third or a quarter of its value.

The structure of the variable pitch delay line according to the invention has numerous advantages without causing technological constructional complications.

A certain number of arrangements provided by the invention for varying the chatracteristics of the cell constituting the line have been enumerated hereinbefore. It is obvious that they can be combined within the scope of the invention.

The invention is not limited to the embodiments described and represented and in fact is applicable to all delay lines having tops and rings. It more particularly applies to lines having a number of tops differing from that of the present embodiment and disposed in gaps between supporting rods of the rings. It is also applicable to the case of waveguides having a cross-section other than the circular cross-section shown and in general terms covers all variants of the subject available to the Expert on the basis of what is shown.

FIG. 2, to which reference has been made for the description of the delay line according to the invention, shows in cross-section a tube constructued with the said line. The latter, formed by three sections I, II and III carries the reference 20. The tube comprises a metal envelope 21 sealed at its two ends by an electron collector 22 and by an insulator tip 23 in which is located an electron gun, whose cathode is shown at 24 and whose heating filament at 25, together with a focusing electrode 26 and an acceleration electrode 27. Under the action of the supply source 28, the cathode emits an electron beam 29, whose contour is indicated by dotted lines. The delay line is coupled to the input and output circuits of the tube, an amplifier in the present embodiment, by antennas 30 and 31. In FIG. 2, 32 designates the brazing strip ensuring the vacuum-tight assembly of the cells 10. For reasons of clarity, only a certain number of cells is shown in each section, whereas in reality each of the sections can have several dozen cells.

A tube equipped with a delay line according to the invention has supplied on a frequency of 3 gigahertz a peak high frequency power of 300 kW for a total applied peak power of 600 kW in the form of 25 μs pulses with a form factor of 60 and a beam intensity of 17 A. The line has about 100 cells.

The invention is generally applicable to the production of high power levels with a wide band width and with a high efficiency in the microwave field, particularly the centimeter wave field.

What is claimed is:

1. A variable pitch delay line for travelling wave tube constituted by cells each of which comprises the following arrangement of elements:

a metal waveguide portion having a hollow cross-section with an axis orthogonally directed with regard to the planes limiting said portion on either side and comprising tops or teeth which project from the periphery of the cross-section towards the centre of the same;

spaced from the tops, a coaxial metal ring fixed to the periphery of the cross-section by supporting rods facing the free spaces between the rods;

a conducting loop in contact with the tops and causing them to be short-circuited, said cells being stacked so as to constitute a wave guide of uniform cross-section in which the tops on the one hand and the supporting rods on the other hand are aligned with one another, an alectron beam propagating in operation along the axis of the wave guide, wherein, for a given cross-section, the cells are varied along said axis by varying at least one of the dimensions in said arrangement, whereby the pitch, that is the distance between homologous points of two consecutive cells, is allowed to vary along said delay line.

2. A delay line according to claim 1, wherein the varied dimension is the distance between the rings and short-circuits.

3. A delay line according to claim 1, wherein the varied dimension is the thickness of the rings and their supporting rods, all having the same thickness.

4. A delay line according to claim 1, wherein the varied dimension is the thickness of the rings.

5. A delay line according to claim 1, wherein the varied dimension is the fraction of the periphery of the cross-section in which the tops extend.

6. A delay line according to claim 1, wherein the varied dimension is the width occupied by the supporting rods between the tops.

7. A delay line according to claim 1, wherein the waveguide portions having a circular cross-section, the ring are circular and wherein both the tops and the supporting rods are shaped like sectors of circular rings and wherein the short-circuits are constituted by circular loops.

8. A variable pitch delay line for travelling-wave tubes according to claim 1, comprising three sections having different pitches succeeding one another over the path of the electron beam and in each of which the pitch is constant, the second section having a smaller pitch and the third section a larger pitch as compared with that of the first, two successive parts being optionally separated by series of cells ensuring the progressive connection of their pitches.

9. A travelling-wave tube, more particularly an amplifier, incorporating means for producing an electron beam and for ensuring its transmission to a collector by which it is collected, and a delay line disposed along the beam path, along which delay line are propagated electromagnetic waves which interact in operation with the beam, wherein said delay line is constituted by cells each of which comprises the following arrangement of elements:

a metal waveguide portion having a hollow cross-section with an axis orthogonally directed with regard to the planes limiting said portion on either side and comprising tops or teeth which project from the periphery of the cross-section towards the centre of the same;

spaced from the tops, a coaxial metal ring fixed to the periphery of the cross-section by supporting rods facing the free spaces between the rods;

a conducting loop in contact with the tops and causing them to be short-circuited; said cells being stacked so as to constitute a wave guide of uniform cross-section in which the tops on the one hand and the supporting rods on the other hand are aligned with one another and wherein, for a given cross-section, the cells are varied along said axis by varying at least one of the dimensions in said arrangement, whereby the pitch, that is the distance between holomogous points of two consecutive cells, is allowed to vary along said delay line.

* * * * *